US010364825B2

(12) United States Patent
Bessho

(10) Patent No.: US 10,364,825 B2
(45) Date of Patent: Jul. 30, 2019

(54) CENTRIFUGAL COMPRESSOR AND TURBOCHARGER

(71) Applicant: IHI Corporation, Koto-ku (JP)

(72) Inventor: Yasutaka Bessho, Tokyo (JP)

(73) Assignee: IHI Corporation, Koto-ku (JP)

( * ) Notice: Subject to any disclaimer, the term of this patent is extended or adjusted under 35 U.S.C. 154(b) by 196 days.

(21) Appl. No.: 15/468,278

(22) Filed: Mar. 24, 2017

(65) Prior Publication Data

US 2017/0198713 A1 Jul. 13, 2017

Related U.S. Application Data

(63) Continuation of application No. PCT/JP2015/085451, filed on Dec. 18, 2015.

(30) Foreign Application Priority Data

Feb. 18, 2015 (JP) ..... 2015-029784

(51) Int. Cl.
*F04D 29/44* (2006.01)
*F04D 17/10* (2006.01)
(Continued)

(52) U.S. Cl.
CPC ..... *F04D 29/441* (2013.01); *F02B 39/00* (2013.01); *F04D 17/10* (2013.01); *F04D 29/284* (2013.01);
(Continued)

(58) Field of Classification Search
CPC .... F04D 17/10; F04D 29/284; F04D 29/4206; F04D 29/4213; F04D 29/441;
(Continued)

(56) References Cited

U.S. PATENT DOCUMENTS 4,063,848 A * 12/1977 Wiggins ..... F04D 27/02 415/172.1
4,212,585 A * 7/1980 Swarden ..... F04D 27/0215 415/198.1
(Continued)

FOREIGN PATENT DOCUMENTS

CN 103174678 A 6/2013
DE 4023724 A1 * 4/1991 ..... F04D 29/4213
(Continued)

OTHER PUBLICATIONS

International Search Report dated Mar. 15, 2016 in PCT/JP2015/085451 filed on Dec. 18, 2015 (with English translation).
(Continued)

*Primary Examiner* — John M Zaleskas
(74) *Attorney, Agent, or Firm* — Oblon, McClelland, Maier & Neustadt, L.L.P.

(57) ABSTRACT

A centrifugal compressor includes a flow changing groove that is formed on an inner wall of the suction passage and extends in a rotation direction of the compressor wheel. A boundary part of a groove wall of the flow changing groove and the inner wall of the suction passage includes an upstream boundary part positioned on an upstream side in the circulation direction of the gas, and a downstream boundary part positioned on a downstream side in the circulation direction. The upstream boundary part is positioned on the inner side in a radial direction of the compressor wheel than the downstream boundary part, and the flow changing groove is positioned on the upstream side of the wheel in the circulation direction.

10 Claims, 5 Drawing Sheets

(51) Int. Cl.

| | |
|---|---|
| ***F04D 29/28*** | (2006.01) |
| ***F04D 29/42*** | (2006.01) |
| ***F02B 39/00*** | (2006.01) |
| ***F04D 29/68*** | (2006.01) |
| *F02B 33/40* | (2006.01) |
| *F02B 37/00* | (2006.01) |

(52) U.S. Cl.
CPC ..... *F04D 29/4206* (2013.01); *F04D 29/4213* (2013.01); *F04D 29/681* (2013.01); *F04D 29/685* (2013.01); *F02B 33/40* (2013.01); *F02B 37/00* (2013.01); *F05D 2220/40* (2013.01); *F05D 2270/101* (2013.01); *F05D 2270/17* (2013.01)

(58) Field of Classification Search
CPC ..... F04D 29/681; F04D 27/0207; F04D 27/0215; F04D 29/685; F02B 33/40; F05D 2220/40; F05D 2250/51; F05D 2270/101
See application file for complete search history.

(56) References Cited

U.S. PATENT DOCUMENTS 4,594,052 A * 6/1986 Niskanen ..... F04D 7/045 415/121.1
4,781,530 A * 11/1988 Lauterbach ..... F04D 29/685 415/173.1
4,930,978 A * 6/1990 Khanna ..... F04D 29/4213 415/58.3
4,930,979 A * 6/1990 Fisher ..... F04D 29/4213 415/206
4,990,053 A * 2/1991 Rohne ..... F04D 29/4213 415/143
5,246,335 A * 9/1993 Mitsubori ..... F04D 29/4213 415/214.1
5,304,033 A * 4/1994 Tang ..... F04D 29/4213 415/206
5,333,990 A * 8/1994 Foerster ..... F04D 29/4213 415/58.4
5,375,974 A * 12/1994 Heinrich ..... F04D 27/0207 415/119
5,466,118 A * 11/1995 Heinrich ..... F04D 29/4213 415/208.3
7,008,191 B2 * 3/2006 Billington ..... F04D 29/266 416/204 A
7,942,625 B2 * 5/2011 Sirakov ..... F04D 29/4213 415/56.5
2002/0182069 A1 * 12/2002 Irie ..... F01D 5/145 415/182.1
2005/0152786 A1 * 7/2005 Ro ..... F04D 29/162 416/242
2006/0275113 A1 * 12/2006 Chen ..... F04D 29/162 415/206
2008/0056882 A1 * 3/2008 Clay ..... F02C 6/12 415/55.6
2010/0098532 A1 * 4/2010 Diemer ..... F04D 27/02 415/203
2010/0111676 A1 * 5/2010 Hollnbuchner ..... F02C 7/045 415/143
2010/0143095 A1 * 6/2010 Higashimori ..... F04D 29/4213 415/58.4
2011/0091323 A1 * 4/2011 Koike ..... F04D 29/284 416/175
2011/0255952 A1 * 10/2011 Williams ..... F04D 29/441 415/1
2013/0343886 A1 * 12/2013 Karim ..... F04D 27/0246 415/208.1
2014/0105736 A1 * 4/2014 Kiriaki ..... F04D 29/441 415/182.1
2014/0377053 A1 * 12/2014 Tamaki ..... F04D 29/4213 415/58.4
2015/0240834 A1 * 8/2015 Vengala ..... F04D 25/024 415/208.2

FOREIGN PATENT DOCUMENTS

| | | | | |
|---|---|---|---|---|
| DE | 10223876 | A1 * | 12/2003 | ..... F01D 5/048 |
| DE | 102014007181 | A1 * | 11/2015 | ..... F04D 29/684 |
| GB | 858808 | A * | 1/1961 | ..... F04D 29/162 |
| JP | 46-42817 | | 12/1971 | |
| JP | 58-18600 | | 2/1983 | |
| JP | 60-50298 | A | 3/1985 | |
| JP | 63-128298 | U | 8/1988 | |
| JP | 4-17198 | U | 2/1992 | |
| JP | 8-74791 | | 3/1996 | |
| JP | 2003-65298 | A | 3/2003 | |
| JP | 2003-343486 | A | 12/2003 | |
| JP | 2010-518314 | | 5/2010 | |
| JP | 2010-525225 | | 7/2010 | |
| JP | 2012-177311 | | 9/2012 | |
| JP | 2014-109214 | | 6/2014 | |
| KR | 20120060021 | A * | 6/2012 | |
| WO | WO 2015152510 | A1 * | 10/2015 | ..... F02M 35/1288 |

OTHER PUBLICATIONS

Written Opinion dated Mar. 15, 2016 in PCT/JP2015/085451 filed on Dec. 18, 2015.
Combined Office Action and Search Report dated Aug. 1, 2018 in Chinese Patent Application No. 201580075531.X with English translation of categories of cited documents, citing documents AO-AR therein, 8 pages.

* cited by examiner

CENTRIFUGAL COMPRESSOR AND TURBOCHARGER

CROSS REFERENCE TO RELATED APPLICATIONS

This application is a continuation application of International Application No. PCT/JP2015/085451, filed on Dec. 18, 2015, which claims priority to Japanese Patent Application No. 2015-029784, filed on Feb. 18, 2015, the entire contents of which are incorporated by reference herein.

BACKGROUND

1. Technical Field

The present disclosure relates to a centrifugal compressor and a turbocharger that compress suction gas by rotation of a wheel.

2. Description of the Related Art

Typically, turbochargers are known to have a shaft with a turbine wheel fitted on one end and a compressor wheel fitted on the other end and the shaft is rotatably supported by a bearing housing. The turbocharger is coupled to an engine, and the turbine wheel is rotated by the action of the exhaust gas discharged from the engine. The rotation of the turbine wheel causes the compressor wheel to rotate via the shaft. In this way, the turbocharger compresses the air by the rotation of the compressor wheel and delivers the compressed air to the engine.

The compressor wheel side of the turbocharger functions as a so-called centrifugal compressor. Generally, in a centrifugal compressor, surging occurs in an area where the suction flow rate is low. Surging occurs when the high pressure suction gas (gas) compressed by the compressor wheel flows back to an upstream side of the compressor wheel, which is the low pressure side, causing unstable behavior of the centrifugal compressor. To address this problem, the centrifugal compressor disclosed in JP S58-18600 A (Patent Literature 1) is provided with a groove ("circular groove" in Patent Literature 1) formed on the inner wall of the housing that accommodates the wheel. The groove is formed in a circular manner and extends in a circumferential direction of the compressor wheel at a position where the groove covers the leading edges of the wings of the compressor wheel. When the suction gas flown back to an area where the suction flow rate is low reaches the circular groove, the suction gas flows along the circular groove whereby the flow direction of the suction gas is changed from backflow to forward flow. This mechanism reduces the impact of the backflow of the suction gas, suppressing the occurrence of surging.

SUMMARY

As explained in Patent Literature 1 mentioned above, the impact of the backflow of the suction gas can be suppressed by forming a groove on the inner wall of the housing. However, because the gas that flows inside the groove causes a loss, developing a technology in which such loss can be suppressed is desired.

An object of the present application is to provide a centrifugal compressor and a turbocharger capable of reducing the pressure loss caused by the backflow of the suction gas.

According to one aspect of the present disclosure, a centrifugal compressor including a housing that includes a suction passage inside thereof; a wheel accommodated inside the suction passage; and a flow changing groove that is formed on an inner wall of the suction passage and extends in a rotation direction of the wheel, wherein a boundary part that continuously connects a groove wall of the flow changing groove and the inner wall of the suction passage includes an upstream boundary part positioned on an upstream side in a circulation direction of suction gas and a downstream boundary part positioned on a downstream side in the circulation direction, the upstream boundary part is positioned on an inner side in a radial direction of the wheel than the downstream boundary part, and the downstream boundary part of the flow changing groove is positioned on the upstream side in the circulation direction than the wheel.

In the above centrifugal compressor, an angle, in the upstream boundary part, between the groove wall of the flow changing groove or the tangential direction thereof and the inner wall of the suction passage or the tangential direction thereof is 90 degrees or less.

In the above centrifugal compressor, an angle, in the downstream boundary part, between the groove wall of the flow changing groove or the tangential direction thereof and the inner wall of the suction passage or the tangential direction thereof is 90 degrees or more.

In the above centrifugal compressor, the flow changing groove includes an upstream groove wall portion that extends in a direction parallel to the radial direction of the wheel from the upstream boundary part, and a downstream groove wall portion that extends from the upstream groove wall portion till the downstream boundary part and is connected to the upstream groove wall portion at an acute angle.

According to another aspect of the present disclosure, a turbocharger includes the above centrifugal compressor.

According to the present disclosure, the pressure loss caused by the backflow of the suction gas can be reduced.

DESCRIPTION OF THE EMBODIMENTS

Exemplary embodiments of the present disclosure are explained in detail below with reference to the accompanying drawings. Dimensions, material, other specific numerical values, and the like mentioned in these embodiments are merely examples that facilitate the understanding of the present disclosure. Furthermore, in the present specification and drawings, structural elements having substantially the same function and configuration are indicated by the same reference symbols and overlapping explanation thereof is omitted. Moreover, structural elements having no direct relation with the present embodiment have been omitted from the drawings.

Figure 1:
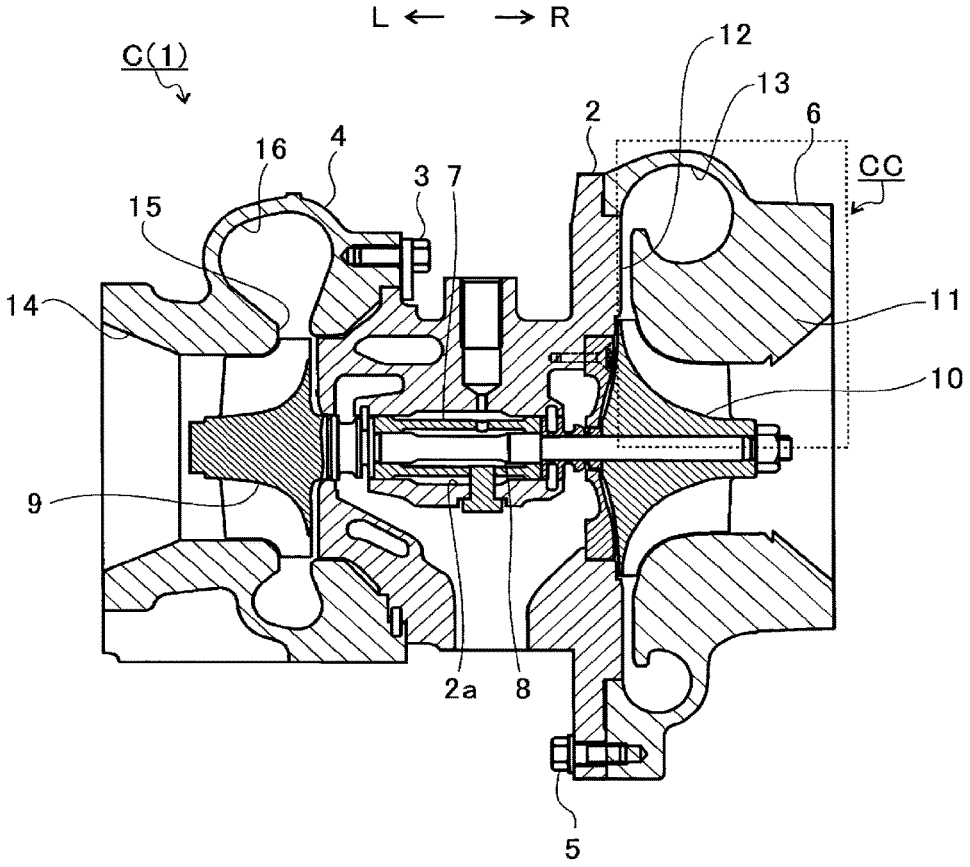
FIG. 1 is a schematic cross-sectional view of a turbocharger according to an embodiment of the present disclosure.

FIG. 1 is a schematic cross-sectional view of a turbocharger C. In the following explanation, an arrow L shown in this figure depicts the left side of the turbocharger C, and an arrow R depicts the right side of the turbocharger C. As shown in FIG. 1, the turbocharger C includes a turbocharger body 1. The turbocharger body 1 includes a bearing housing 2 (housing), a turbine housing 4 connected to the left edge of the bearing housing 2 with a fastening bolt 3, and a compressor housing 6 (housing) connected to the right edge of the bearing housing 2 with a fastening bolt 5. All these structural elements are integrated to form a single piece.

A bearing hole 2*a* that passes through the bearing housing 2 in the left-right direction of the turbocharger C is formed in the bearing housing 2. A bearing 7 is arranged inside the bearing hole 2*a*. The bearing 7 rotatably supports a shaft 8. A turbine wheel 9 is integrally fixed to the left end of the shaft 8 and the turbine wheel 9 is rotatably accommodated inside the turbine housing 4. A compressor wheel (wheel) 10 is integrally fixed to the right end of the shaft 8 and the compressor wheel 10 is rotatably accommodated inside the compressor housing 6.

A suction port 11 is formed in the compressor housing 6. The suction port 11 opens on the right side of the turbocharger C and is connected to an air cleaner (not-shown). In a state in which the bearing housing 2 and the compressor housing 6 are connected to each other with the fastening bolt 5, surfaces of both the housings 2 and 6 that are facing each other form a diffuser passage 12 that is operative to increase the pressure of gas (for example, air). The diffuser passage 12 is formed in a circular manner from the inner side to the outer side in a radial direction of the shaft 8. The diffuser passage 12 communicates with the suction port 11 via the compressor wheel 10 on the inner side in the radial direction of the shaft 8.

A compressor scroll passage 13 is formed in the compressor housing 6. The compressor scroll passage 13 is formed in a circular manner and is positioned on the outer side in the radial direction of the shaft 8 than the diffuser passage 12. The compressor scroll passage 13 communicates with a suction port (not-shown) of an engine. The compressor scroll passage 13 also communicates with the diffuser passage 12. Accordingly, when the compressor wheel 10 rotates, the gas gets sucked into the compressor housing 6 from the suction port 11. When the gas is circulated between wings of the compressor wheel 10, the pressure and the speed of the sucked gas are increased. Due to such increase in the pressure (recovering the pressure) in the diffuser passage 12 and the compressor scroll passage 13, the compressed gas is guided to the engine.

A discharge port 14 is formed in the turbine housing 4. The discharge port 14 opens on the left side of the turbocharger C and is connected to an exhaust gas purifying device (not-shown). Moreover, a flow passage 15 and a turbine scroll passage 16 positioned on the outer side in the radial direction of the shaft 8 than the flow passage 15 are formed in the turbine housing 4. The turbine scroll passage 16 communicates with a gas inlet (not-shown) to which the exhaust gas discharged from an exhaust manifold (not-shown) of the engine is guided. The turbine scroll passage 16 also communicates with the flow passage 15. Accordingly, the exhaust gas guided from the gas inlet to the turbine scroll passage 16 is guided toward the discharge port 14 via the flow passage 15 and the turbine wheel 9. During such a circulation, the exhaust gas rotates the turbine wheel 9. The rotation force of the turbine wheel 9 is transmitted to the compressor wheel 10 via the shaft 8, and the compressor wheel 10 is caused to rotate. The rotation force of the compressor wheel 10 causes the pressure of the gas to increase thereby guiding the gas to the engine.

In this manner, the structural elements on the compressor housing 6 side in the turbocharger C function as a centrifugal compressor CC that compresses the suction gas (gas) guided from the suction port 11 to the diffuser passage 12 by the rotation of the compressor wheel 10.

Figure 2:
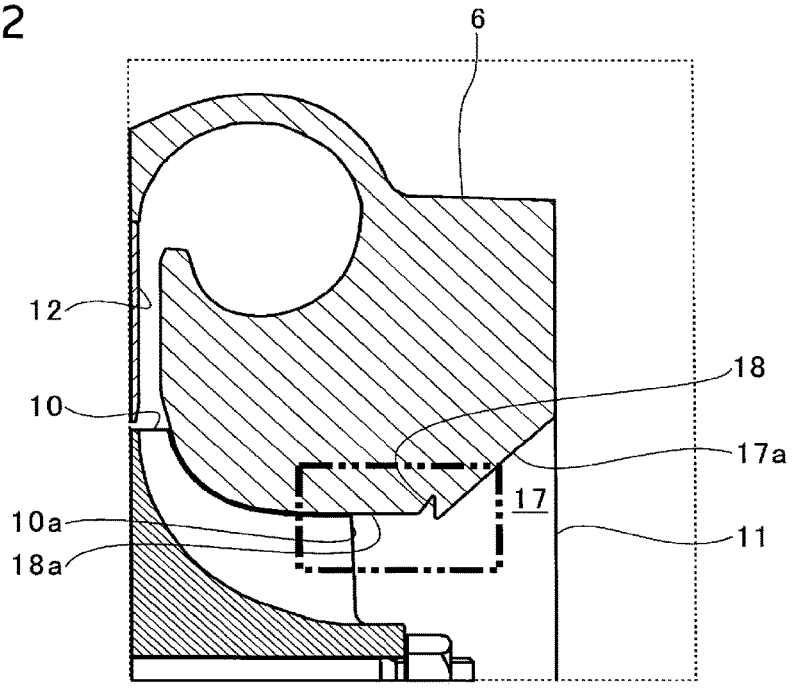
FIG. 2 is an extracted view of a part surrounded with a broken line in FIG. 1.

FIG. 2 is an extracted view of a part surrounded with a broken line in FIG. 1. As shown in FIG. 2, a suction passage 17 is a gas flow passage that communicates from the suction port 11 to the diffuser passage 12. The suction passage 17 guides the suction gas flown inside thereof from the suction port 11 to the diffuser passage 12. The compressor wheel 10 is accommodated inside the suction passage 17.

A flow changing groove 18 is formed on an inner wall 17*a* of the suction passage 17. The flow changing groove 18 is a circular groove that extends in a rotation direction of the compressor wheel 10. The flow changing groove 18 is arranged further on the suction port 11 side in an axial direction of the compressor wheel 10 than the compressor wheel 10. In other words, the flow changing groove 18 is positioned on an upstream side in a circulation direction of the suction gas (in a direction from the suction port 11 toward the compressor wheel 10) than the compressor wheel 10. In detail, the position of an end part 18*a* of the flow changing groove 18 (an end part on the left side in FIG. 2) is further on the suction port 11 side than the position of an end part 10*a* of the compressor wheel 10 on the suction port 11 side.

Figure 3:
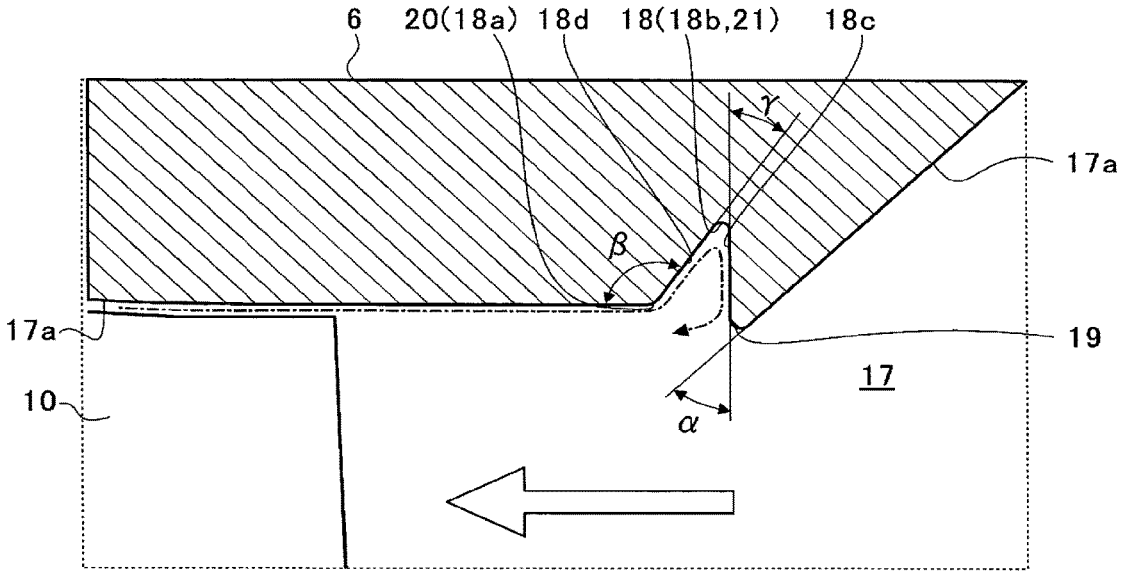
FIG. 3 is an extracted view of a part surrounded with by a two-dot chain line in FIG. 2.

FIG. 3 is an extracted view of a part surrounded with a two-dot chain line in FIG. 2. As shown in FIG. 3, a boundary part that continuously connects a groove wall 18*b* of the flow changing groove 18 and the inner wall 17*a* of the suction passage 17 includes an upstream boundary part 19 positioned upstream in the circulation direction of the suction gas (right side in FIG. 3) and a downstream boundary part 20 positioned downstream in the circulation direction of the suction gas (left side in FIG. 3). In other words, the boundary part is formed where the groove wall 18*b* and the inner wall 17*a* of the suction passage 17 connect to each other. Moreover, the upstream boundary part 19 is positioned further on the inner side (lower side in FIG. 3) in a radial direction of the compressor wheel 10 than the downstream boundary part 20.

FIG. 3 shows, for example, a plane cross section that includes a rotation axis of the compressor wheel 10. As shown in this figure, the upstream boundary part 19 and the downstream boundary part 20 have a curved surface.

An angle $\alpha$ between a tangential direction of the groove wall 18*b* and a tangential direction of the inner wall 17*a* of the suction passage 17 in the upstream boundary part 19 is 90 degrees or less.

An angle $\beta$ between the tangential direction of the groove wall 18*b* and the tangential direction of the inner wall 17*a* of the suction passage 17 in the downstream boundary part 20 is 90 degrees or more.

The groove wall 18*b* of the flow changing groove 18 includes an upstream groove wall portion 18*c* and a downstream groove wall portion 18*d*. The upstream groove wall portion 18*c* is a part that extends from the upstream boundary part 19 in a direction parallel to the radial direction of the compressor wheel 10. The downstream groove wall portion 18*d* is a part that extends from the downstream boundary part 20 till the edge of the upstream groove wall portion 18*c*. As shown in FIG. 3, a boundary part 21 of the upstream groove wall portion 18*c* and the downstream groove wall portion 18*d* have a curved surface. An angle $\gamma$ between the tangential directions of the upstream groove wall portion 18*c* and the downstream groove wall portion 18*d* in the boundary part 21 is an acute angle.

The gas flows to the suction passage 17 from the suction port 11 and then flows toward the diffuser passage 12. In other words, as indicated by a hollow arrow in FIG. 3, the gas flows toward the left side. At this time, in an area of the turbocharger C where the suction flow rate is low, as indicated by a one-dot chain line arrow, a part of the high pressure suction gas compressed by the compressor wheel 10 flows back to the upstream side of the compressor wheel 10, which is a low pressure side, in the vicinity of the inner wall 17*a* of the suction passage 17.

The flown back suction gas flows along the inner wall 17*a* of the suction passage 17 and the groove wall 18*b* of the flow changing groove 18 by the action of the centrifugal force. Specifically, when the suction gas flown back from the downstream groove wall portion 18*d* toward the upstream groove wall portion 18*c* flows inside the flow changing groove 18, the flow direction of the suction gas changes (deflects) and the deflected suction gas merges with the main flow of the suction gas.

In the flow changing groove 18 of the present embodiment, the upstream groove wall portion 18*c* that protrudes radially inward functions as a "means to return (reflector)" of the backflow, and reduces the interference (mixing loss) because of the merging of the flown back suction gas with the main flow of the suction gas. In such a configuration, loss because of the backflow of the suction gas can be reduced.

Because the effect of the centrifugal force of the wheel is significant on the compressor wheel 10 side (the upstream side in a backflow direction of the suction gas), the flow of the backflow suction gas is complicated and unstable. On the other hand, when the suction gas has flown back to the downstream side of the compressor wheel 10, the flow of the suction gas becomes stable. Because the flow changing groove 18 is arranged further on the suction port 11 side in the axial direction of the compressor wheel 10 than the compressor wheel 10, the frictional drag between the wall surface and the gas flow flown inside the flow changing groove 18 can be reduced. As a result, the pressure loss can be further suppressed.

Figure 4A:
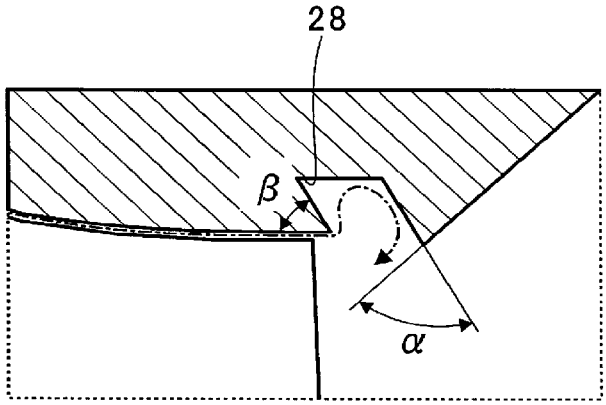
FIGS. 4A to 4C are views for respectively explaining first to third modifications of the present embodiment.
Figure 4B:
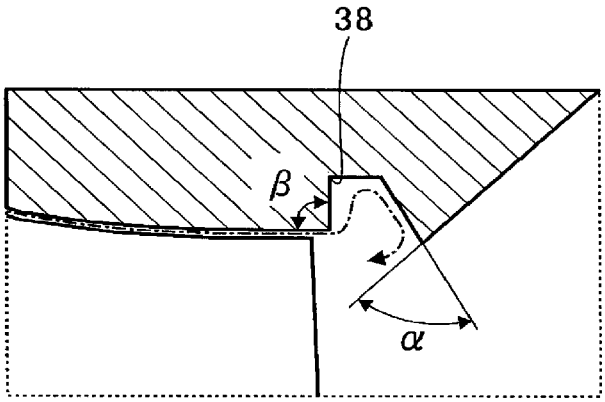
Figure 4C:
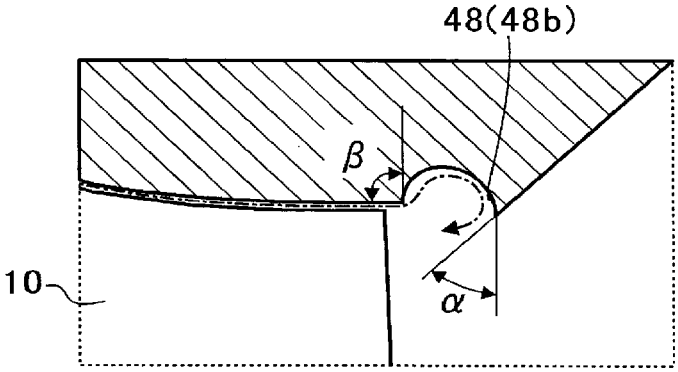

FIGS. 4A to 4C are views for respectively explaining first to third modifications of the present embodiment. As shown in FIG. 4A, in a flow changing groove 28 according to the first modification, similar to the embodiment explained above, the angle $\alpha$ is an acute angle. In contrast, the angle $\beta$ is an acute angle.

As shown in FIG. 4B, in a flow changing groove 38 according to the second modification, the angle $\alpha$ is 90 degrees or less, and the angle $\beta$ is a right angle.

As shown in FIG. 4C, in a flow changing groove 48 according to the third modification, similar to the embodiment explained above, the angle $\alpha$ is 90 degrees or less, and the angle $\beta$ is 90 degrees or more. However, a groove wall 48*b* of the flow changing groove 48 has a curved surface as shown in FIG. 4.

Figure 5A:
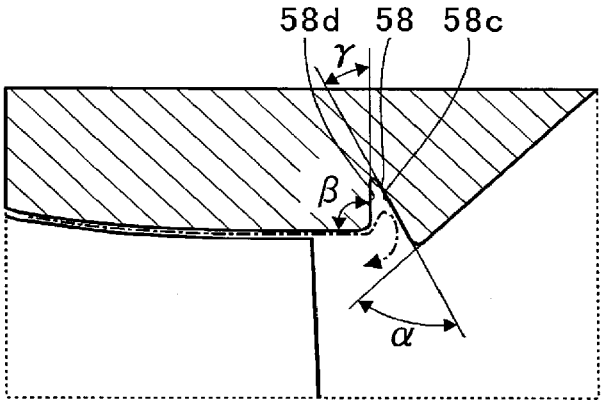
FIGS. 5A to 5C are views for respectively explaining fourth to sixth modifications of the present embodiment.
Figure 5B:
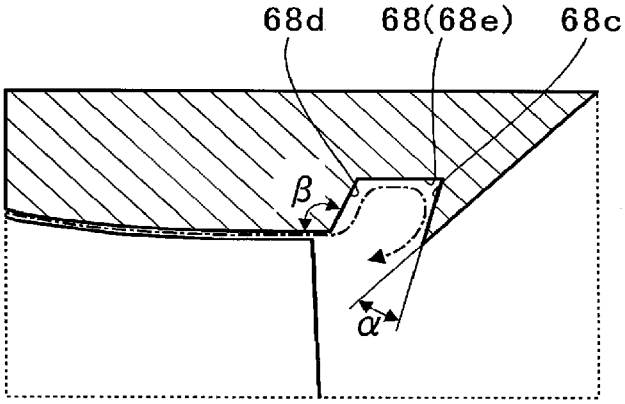
Figure 5C:
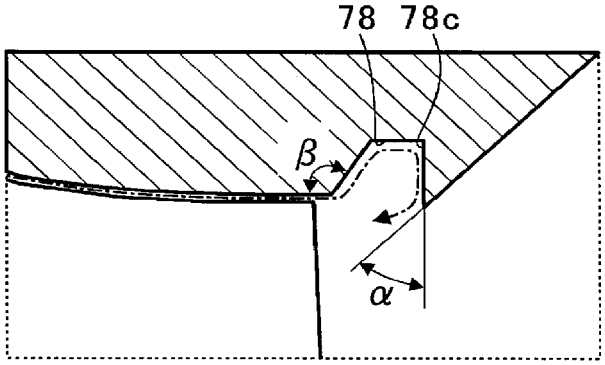

FIGS. 5A to 5C are views for respectively explaining fourth to sixth modifications of the present embodiment. As shown in FIG. 5A, in a flow changing groove 58 according to the fourth modification, the angle $\alpha$ is 90 degrees or less, the angle $\beta$ is a right angle, and the angle $\gamma$ is an acute angle. Moreover, an upstream groove wall portion 58*c* is inclined with respect to the radial direction of the compressor wheel 10, and a downstream groove wall portion 58*d* is positioned in a direction parallel to the radial direction of the compressor wheel 10.

As shown in FIG. 5B, in a flow changing groove 68 according to the fifth modification, similar to the embodiment explained above, the angle $\alpha$ is 90 degrees or less, and the angle $\beta$ is 90 degrees or more. However, different from the embodiment explained above, a bottom portion 68*e* that extends in a direction of the rotation axis of the compressor wheel 10 is formed between an upstream groove wall portion 68*c* and a downstream groove wall portion 68*d*.

As shown in FIG. 5C, in a flow changing groove 78 according to the sixth modification, the angle $\alpha$ is 90 degrees or less, and the angle $\beta$ is 90 degrees or more. Moreover, an upstream groove wall portion 78*c* is arranged in a direction parallel to the radial direction of the compressor wheel 10.

In this manner, as long as the upstream boundary part 19 is positioned further on the inner side in the radial direction of the compressor wheel 10 than the downstream boundary part 20, various modifications can be made to the shape of the flow changing groove according to the present disclosure. In other words, as long as the above condition is satisfied, the shape of the flow changing groove is not limited to the one shown in the figures.

For example, in the embodiment explained above, the upstream boundary part 19, the downstream boundary part 20, and the boundary part 21 formed between the upstream groove wall portion 18*c* and the downstream groove wall portion 18*d* have curved surfaces as shown in FIG. 3. However, any one of the upstream groove wall portion 18*c* and the inner wall 17*a* of the suction passage 17 present on the upstream boundary part 19 can have a curved shape, and the other one can be linear in the cross section shown in FIG. 3. Alternatively, both the structural elements can be linear in the cross section shown in FIG. 3.

Similarly, any one of the downstream groove wall portion 18*d* and the inner wall 17*a* of the suction passage 17 present on the downstream boundary part 20 can have a curved shape, and the other one can be linear in the cross section shown in FIG. 3. Alternatively, both the structural elements can be linear in the cross section shown in FIG. 3.

Similarly, any one of the upstream groove wall portion 18*c* and the downstream groove wall portion 18*d* present on the boundary part 21 of the upstream groove wall portion 18*c* and the downstream groove wall portion 18*d* can have a curved shape and the other one can be linear in the cross section shown in FIG. 3. Alternatively, both the structural elements can be linear in the cross section shown in FIG. 3.

In any one of the configurations explained above, the angle $\alpha$ is an angle between the upstream groove wall portion 18*c* or the tangential direction thereof and the inner wall 17*a* of the suction passage 17 or the tangential direction thereof on the upstream boundary part 19.

The angle $\beta$ is an angle between the downstream groove wall portion 18*d* or the tangential direction thereof and the inner wall 17*a* of the suction passage 17 or the tangential direction thereof on the downstream boundary part 20.

Moreover, the angle $\gamma$ is an angle between the upstream groove wall portion 18*c* or the tangential direction thereof and the downstream groove wall portion 18*d* or the tangential direction thereof on the boundary part 21 of the upstream groove wall portion 18*c* and the downstream groove wall portion 18*d*.

Even if a configuration where the angle $\alpha$ is 90 degrees or less has been presented as an example in the embodiment and the modifications explained above, the angle $\alpha$ can be an obtuse angle. However, by setting the angle $\alpha$ to 90 degrees or less as explained in the embodiment and the modifications, the main flow of the suction gas merging from the inner side of the flow changing grooves 18, 28, 38, 48, 58, 68, and 78 can be directed in the direction same as that of the suction gas from the flow changing grooves 18, 28, 38, 48, 58, 68, and 78. As a result, mixing loss can be reduced compared to the configuration where the angle α is an obtuse angle. In other words, a stable deflection effect (functioning as a deflector) can be achieved with the flow changing grooves 18, 28, 38, 48, 58, 68, and 78.

Moreover, in the embodiment and the second to sixth modifications explained above, even if the configuration where the angle β is 90 degrees or more has been presented as an example, the angle β can be an acute angle. However, by setting the angle β to 90 degrees or more as explained in the embodiment and the second to sixth modifications, compared to the configuration where the angle β is an acute angle, the flow changing grooves 18, 38, 48, 58, 68, and 78 can be formed in a shape from which the suction gas flown back inside the groove can be easily guided outside the flow changing groove.

In the embodiment explained above, a configuration where the upstream groove wall portion 18*c* extends in a direction parallel to the radial direction of the compressor wheel 10, and the angle γ is an acute angle has been presented as an example. However, as explained in connection to the fourth modification, the upstream groove wall portion 58*c* can be inclined with respect to the radial direction of the compressor wheel 10. In such a configuration, by causing the upstream groove wall portion 58*c* to extend in a direction parallel to the radial direction of the compressor wheel 10 and setting the angle γ as an acute angle, the direction of the suction gas that is merging into the main flow from the flow changing groove 18 can be directed in the flow direction of the main flow. As a result, the mixing loss can be reduced.

In the embodiment and the fourth modification explained above, by forming the flow changing groove 18 and 58 in a V-shaped cut, the contact perimeter (surface area) of the flow changing groove 18 can be kept minimum. As a result, the friction loss between the surface of the flow changing groove 18 and the suction gas flowing therein can be reduced.

As explained in the third modification explained above, by forming the flow changing groove 48 having a curved surface, stagnation of the suction gas inside the flow changing groove 48 does not occur easily, and also the pressure loss can be reduced.

Figure 6:
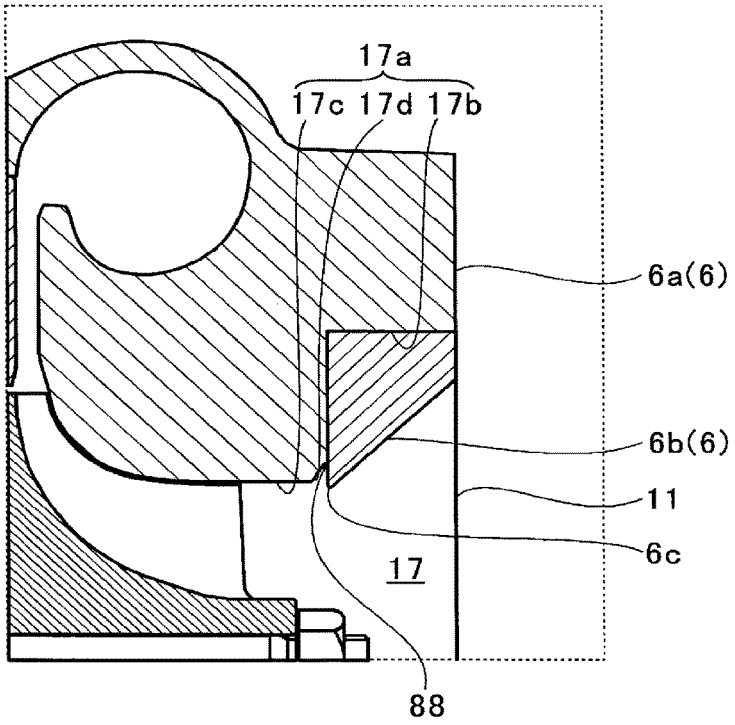
FIG. 6 is a view for explaining a seventh modification of the present embodiment.

FIG. 6 is a view explaining a seventh modification in which a part corresponding to FIG. 2 according to the seventh modification is depicted. As shown in FIG. 6, the compressor housing 6 according to the seventh modification is constituted by a main body 6*a* and a circular member 6*b*. In the main body 6*a*, a large diameter part 17*b* and a small diameter part 17*c* are formed on the inner wall 17*a* of the suction passage 17 in this sequence from the suction port 11 side. The large diameter part 17*b* has a larger inner diameter than the small diameter part 17*c*. A tapered part 17*d* is formed on the boundary of the large diameter part 17*b* and the small diameter part 17*c* in an inclined manner such that the inner diameter thereof becomes larger in the suction port 11 side.

The circular member 6*b* is inserted and secured on the large diameter part 17*b*. When the circular member 6*b* is inserted in the large diameter part 17*b*, an end part 6*c* of the circular member 6*b* on the inner circumference side is positioned on the inner side in the radial direction of the compressor wheel 10 than the tapered part 17*d*. In such a configuration, the groove formed by the tapered part 17*d* and the circular member 6*b* is a flow changing groove 88.

Accordingly, even if the compressor housing 6 is constituted by the main body 6*a* and the circular member 6*b*, similar to the embodiment explained above, loss of suction gas because of backflow can be reduced. Moreover, because the flow changing groove 88 can be formed if the tapered part 17*d* is machined before fitting the circular member 6*b*, the workability can be improved. Furthermore, just by retrofitting the circular member 6*b*, the position of the end part 6*c* of the circular member 6*b* in the radial direction can be easily changed.

Exemplary embodiments of the present disclosure are explained above. The present disclosure, however, is not limited to the above embodiments. In the category specified in the scope of the claims, it is obvious for a person skilled in the art to arrive at various modifications or revisions, and it should be understood by the person skilled in the art that such modifications or revisions fall within the technical scope of the present disclosure.

What is claimed is:

1. A centrifugal compressor comprising:
a housing including a suction passage inside thereof;
a wheel accommodated inside the suction passage; and
a flow changing groove that is formed on an inner wall of the suction passage and extends in a rotation direction of the wheel, wherein
a boundary part that continuously connects a groove wall of the flow changing groove and the inner wall of the suction passage includes an upstream boundary part and a downstream boundary part positioned downstream from the upstream boundary part in a circulation direction of suction gas,
the upstream boundary part is positioned on an upstream side of the groove wall in the circulation direction and inward of the downstream boundary part in a radial direction of the wheel, and
the downstream boundary part is positioned on a downstream side of the groove wall and upstream from the wheel in the circulation direction.

2. The centrifugal compressor according to claim 1, wherein an angle, in the upstream boundary part, between the groove wall of the flow changing groove or the tangential direction thereof and the inner wall of the suction passage or the tangential direction thereof is 90 degrees or less.

3. The centrifugal compressor according to claim 2, wherein an angle, in the downstream boundary part, between the groove wall of the flow changing groove or the tangential direction thereof and the inner wall of the suction passage or the tangential direction thereof is 90 degrees or more.

4. The centrifugal compressor according to claim 2, wherein the flow changing groove includes an upstream groove wall portion that extends in a direction parallel to the radial direction of the wheel from the upstream boundary part, and a downstream groove wall portion that extends from the upstream groove wall portion until the downstream boundary part and is connected to the upstream groove wall portion at an acute angle.

5. The centrifugal compressor according to claim 1, wherein an angle, in the downstream boundary part, between the groove wall of the flow changing groove or the tangential direction thereof and the inner wall of the suction passage or the tangential direction thereof is 90 degrees or more.

6. The centrifugal compressor according to claim 5, wherein the flow changing groove includes an upstream groove wall portion that extends in a direction parallel to the radial direction of the wheel from the upstream boundary part, and a downstream groove wall portion that extends from the upstream groove wall portion until the downstream boundary part and is connected to the upstream groove wall portion at an acute angle.

7. The centrifugal compressor according to claim 3, wherein the flow changing groove includes an upstream groove wall portion that extends in a direction parallel to the radial direction of the wheel from the upstream boundary part, and a downstream groove wall portion that extends from the upstream groove wall portion until the downstream boundary part and is connected to the upstream groove wall portion at an acute angle.

8. The centrifugal compressor according to claim 1, wherein the flow changing groove includes an upstream groove wall portion that extends in a direction parallel to the radial direction of the wheel from the upstream boundary part, and a downstream groove wall portion that extends from the upstream groove wall portion until the downstream boundary part and is connected to the upstream groove wall portion at an acute angle.

9. The centrifugal compressor according to claim 8, wherein a boundary part of the upstream groove wall portion and the downstream groove wall portion is curved.

10. A turbocharger comprising the centrifugal compressor according to claim 1.

* * * * *